US011591709B2

(12) United States Patent
Takahashi

(10) Patent No.: US 11,591,709 B2
(45) Date of Patent: Feb. 28, 2023

(54) APPARATUS FOR PLATING

(71) Applicant: EBARA CORPORATION, Tokyo (JP)

(72) Inventor: Naoto Takahashi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 16/903,615

(22) Filed: Jun. 17, 2020

(65) Prior Publication Data

US 2021/0010147 A1 Jan. 14, 2021

(30) Foreign Application Priority Data

Jul. 9, 2019 (JP) ..... 127501/2019

(51) Int. Cl.
*C25D 17/10* (2006.01)
*C25D 7/12* (2006.01)
*C25D 17/00* (2006.01)

(52) U.S. Cl.
CPC ..... *C25D 17/007* (2013.01); *C25D 7/123* (2013.01); *C25D 17/001* (2013.01); *C25D 17/002* (2013.01); *C25D 17/10* (2013.01)

(58) Field of Classification Search
CPC ..... C25D 17/007; C25D 7/12–123; H01L 21/00–86
See application file for complete search history.

(56) References Cited

U.S. PATENT DOCUMENTS 5,516,412 A * 5/1996 Andricacos ..... C25D 17/00 204/224 M
5,522,975 A * 6/1996 Andricacos ..... C25D 17/06 204/297.08
2009/0068771 A1 3/2009 Chae et al.
2010/0032310 A1* 2/2010 Reid ..... C25D 17/001 205/261
2010/0044236 A1* 2/2010 Mayer ..... C25F 3/30 204/252
2016/0313641 A1* 10/2016 De ..... G03C 1/805
2017/0058423 A1* 3/2017 Mine ..... C25D 17/001
2017/0058424 A1* 3/2017 Wilson ..... C25D 17/002

FOREIGN PATENT DOCUMENTS

JP S58-093993 A 6/1983
JP 2017-043815 A 3/2017
JP 2018-040045 A 3/2018
JP 2019-007075 A 1/2019
JP 2019-014955 A 1/2019

* cited by examiner

*Primary Examiner* — Ho-Sung Chung
(74) *Attorney, Agent, or Firm* — BakerHostetler

(57) ABSTRACT

There is provided an apparatus for plating a substrate as an object to be plated. The apparatus comprises an anode and a thief tunnel arranged to be located between the substrate and the anode when the substrate is placed to be opposed to the anode. The thief tunnel comprises a body placed away from the substrate and provided with an opening; a plurality of auxiliary electrodes provided in or to the body; and an ion exchange membrane configured to protect the auxiliary electrodes from a plating solution. The plurality of auxiliary electrodes are arranged along a circumference of the opening. At least one of the auxiliary electrodes is configured such that a voltage to be applied to the at least one of the auxiliary electrodes is controlled independently of a voltage to be applied to one or more auxiliary electrodes other than the at least one of the auxiliary electrodes.

7 Claims, 7 Drawing Sheets

APPARATUS FOR PLATING

TECHNICAL FIELD

The present disclosure relates to a thief tunnel that is a new configuration to control the flow of plating current and an apparatus for plating provided with the thief tunnel.

BACKGROUND ART

A conventional procedure forms wiring in a fine groove for wiring, a fine hole or a fine resist opening provided on a surface of a semiconductor wafer or the like and forms a bump (projected electrode) on the surface of the semiconductor wafer or the like to be electrically connected with an electrode or the like of a package. Known methods employed to form the wiring and the bump include, for example, an electroplating method, a deposition method, a printing method, and a ball bump method. The electroplating method that allows for miniaturization and has relatively stable performance has been used widely, accompanied with a recent increase in the I/O number of a semiconductor chip and a recent pitch miniaturization.

Such an electroplating apparatus has been used to plate large-sized angular substrates with a view to enhancing the cost effectiveness. Japanese Unexamined Patent Publication No. 2018-040045 (Patent Document 1) describes a configuration of a substrate holder to hold such an angular substrate and soak the angular substrate in a plating solution. Japanese Patent Application No. 2018-079388 (Patent Document 2) describes a configuration of a substrate holder for plating to bring a plurality of electric contacts into contact with a peripheral portion of an angular substrate to supply electric power. Japanese Unexamined Patent Publication No. 2017-043815 (Patent Document 3) describes a plating apparatus configured to supply electric currents of different intensities according to areas (a side center area, a side intermediate area, and a corner area) from a plurality of electric contacts of a substrate holder to a peripheral portion of an angular substrate. Japanese Unexamined Patent Publication No. 2019-014955 (Patent Document 4) describes a configuration that a demountable shielding member is provided at a regulation plate, an anode holder and an opening of a substrate holder placed in a plating tank.

RELATED ART DOCUMENT

Patent Document

Patent Document 1: Japanese Unexamined Patent Publication No. 2018-040045

Patent Document 2: Japanese Patent Application No. 2018-079388

Patent Document 3: Japanese Unexamined Patent Publication No. 2017-043815

Patent Document 4: Japanese Unexamined Patent Publication No. 2019-014955

SUMMARY OF INVENTION

In the process of plating a substrate such as a wafer or a printed circuit board, concentration of electric current in a peripheral portion of the substrate due to the sneak current (sneak path current, current flowing round) and the effect of electric resistance in a location of a seed layer tends to increase the film thickness in the peripheral portion. With a view to equalizing the flow of electric current, a shield plate or the like is placed in a portion where the electric current is more likely to flow. The optimum shape of the shield plate is, however, different for different products having different resist patterns on a substrate, different opening ratios of the resist pattern, different film thicknesses of a seed layer and the like. There is accordingly a need to change the shield plate for each product. A configuration has been proposed to automatically and freely change the size of the opening of the shield plate for the wafer or the like. A substrate of the more complicated shape, for example, an angular substrate, however, has a problem, for example, a requirement for the complicated design of a driving device to change the opening of the shield plate. With a view to further improving the plating quality, it is also effective to consider a novel technique of controlling the electric field, in addition to or in place of a conventional controlling technique of the electric field.

A substrate having a plurality of sides on its periphery, such as an angular (polygonal) substrate has an increased amount of plating in the vicinity of each power feed point and is also likely to cause the vicinity of each intersection of the sides to be a specific point having an increased or decreased amount of plating. This provides an uneven plating film thickness in the vicinity of such a specific point.

An object of the present disclosure is to solve at least part of the problems described above.

According to one aspect of the present disclosure, there is provided an apparatus for plating a substrate as an object to be plated. The apparatus for plating comprises an anode configured to make electric current flow between the substrate and the anode; and a thief tunnel arranged to be located between the substrate and the anode when the substrate is placed to be opposed to the anode. The thief tunnel comprises a body placed away from the substrate and provided with an opening; a plurality of auxiliary electrodes provided in or to the body; and an ion exchange membrane configured to protect the auxiliary electrodes from a plating solution. The plurality of auxiliary electrodes are arranged along a circumference of the opening. At least one of the auxiliary electrodes is configured such that a voltage to be applied to the at least one of the auxiliary electrodes is controlled independently of a voltage to be applied to one or more auxiliary electrodes other than the at least one of the auxiliary electrodes.

DESCRIPTION OF EMBODIMENTS

Figure 1:
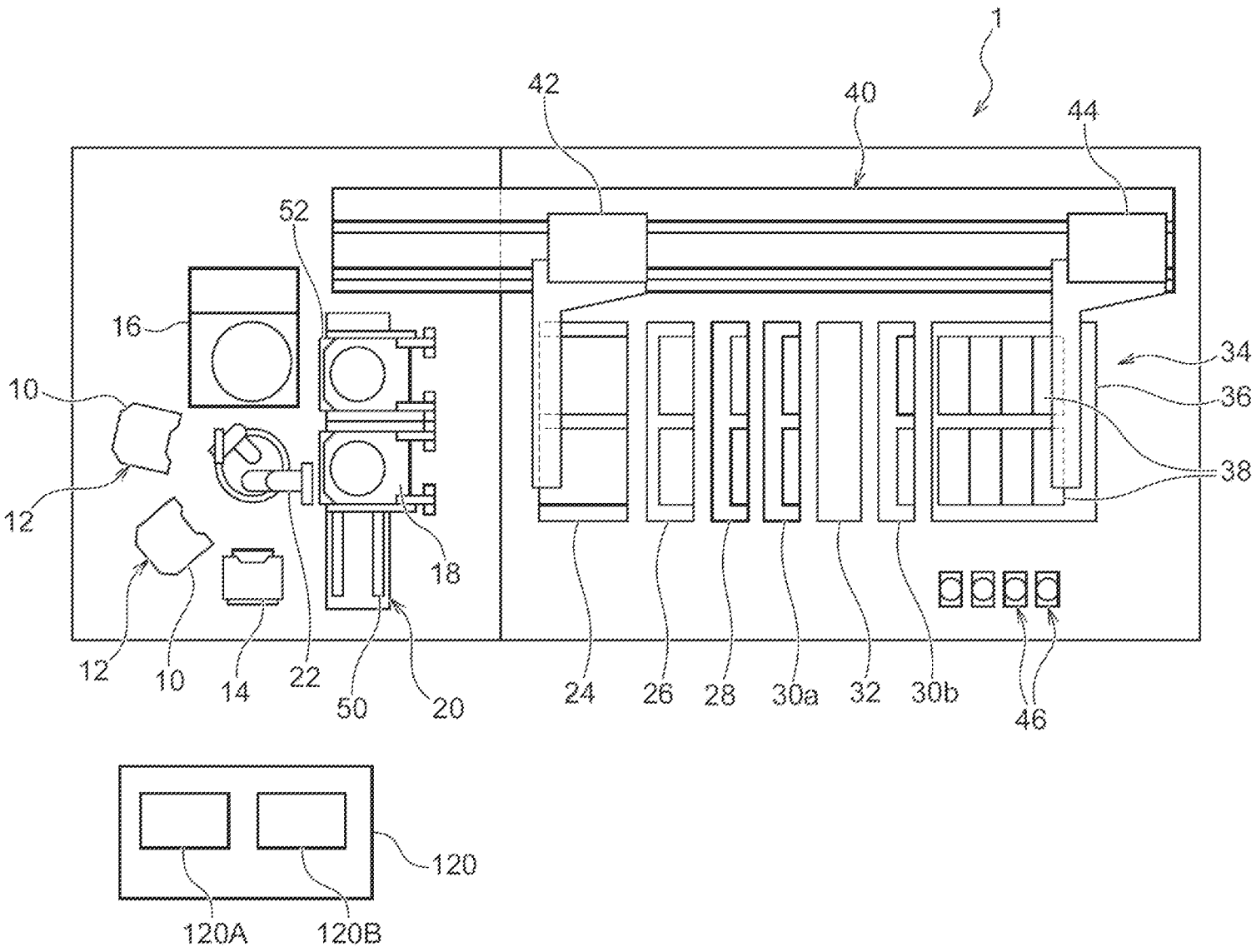
FIG. 1 is a general layout drawing illustrating a plating apparatus according to one embodiment.

The following describes more detailed embodiments of the present disclosure with reference to drawings. In the drawings described below, similar or equivalent components are expressed by similar reference signs with omission of overlapping description.

FIG. 1 is a general layout drawing illustrating a plating apparatus according to one embodiment. A plating apparatus 1 may have a configuration used for double-sided plating, a configuration used for single-sided plating or a configuration used for both double-sided plating and single-sided plating. With referring to FIG. 1, this plating apparatus 1 includes two cassette tables 12 configured such that cassettes 10 respectively having substrates, such as semiconductor wafers, placed therein are mounted on the cassette tables 12; an aligner 14 configured to adjust the position of an OF (orientation flat) or a notch of a substrate to a predetermined direction; a loading/unlading station 20 configured to load and unload substrates onto and from substrate holders 18 placed thereon; and a spin dryer 16 configured to rotate a substrate after a plating process at a high speed so as to dry the substrate or a spin rinse dryer 16 additionally having a cleaning function. A substrate transfer device 22, for example, a transfer robot, configured to transfer the substrate between these units is placed at the approximate center of these units. The substrate may be any substrate, for example, a semiconductor wafer, a printed circuit board, a liquid crystal board, or an MEMS. The substrate may be in a circular shape, an angular (polygonal) shape or any other arbitrary shape.

The loading/unloading station 20 includes a mounting plate 52 in a flat plate-like shape configured to be slidable in a horizontal direction along rails 50. In such a state that two substrate holders 18 are mounted horizontally in parallel to each other on the mounting plate 52, the substrate transfer device 22 transfers a substrate to and from one substrate holder 18. The substrate transfer device 22 subsequently slides the mounting plate 52 in the horizontal direction and transfers a substrate to and from the other substrate holder 18.

A stocker 24 configured to store and temporarily place the substrate holder 18 therein, a prewet module 26 configured to soak a substrate in pure water, a presoak module 28 configured to remove an oxide film on the surface of a seed layer formed on the surface of the substrate by etching, a first rinse module 30*a* configured to wash the surface of the substrate with pure water or the like, a blow module 32 configured to drain the substrate after washing, a second rinse module 30*b* configured to wash the surface of the substrate with pure water or the like, and a plating module 34 are placed in the plating apparatus 1. The layout of the respective units is not limited to the illustrated layout, but another configuration and another layout may be employed.

The plating module 34 includes an overflow tank 36 and a plurality of plating baths 38 placed inside thereof. In each of the plating baths 38, the substrate holder 18 that holds a substrate therein is placed inside of the plating bath 38 to be subjected to a plating process, for example, copper plating. The following describes copper plating according to this embodiment. The plating apparatus 1 is, however, similarly used for plating of other materials, such as nickel, solder, silver and gold. Paddle driving devices 46 are placed on the side of the overflow tank 36 to drive paddles (not shown) that are located inside of the respective plating baths 38 to stir plating solutions.

The plating apparatus 1 is provided with a substrate holder transfer device 40 configured to transfer the substrate holder 18 with a substrate W. The substrate holder transfer device 40 is, for example, a linear motor type and is placed on the side of the loading/unloading station 20 and the respective modules described above. The substrate holder transfer device 40 includes a first transporter 42 and a second transporter 44. The first transporter 42 is configured to transfer the substrate between the loading/unloading station 20 and the stocker 24. The second transporter 44 is configured to transfer the substrate between the stocker 24, the prewet module 26, the presoak module 28, the rinse modules 30*a* and 30*b*, the blow module 32 and the plating module 34. The transfer paths described above are only illustrative, and each of the first transporter 42 and the second transporter 44 may employ other transfer paths. One modification of the substrate holder transfer device 40 may include only the first transporter 42 with omission of the second transporter 44.

A controller 120 is configured to control the operations of the respective components of the plating apparatus described above and thereby control substrate processing operations. The controller 120 includes a memory 120A configured to store various set data and various programs therein and a CPU 120*b* configured to perform the programs stored in the memory. A storage medium that configures the memory may include a volatile storage medium and/or a non-volatile storage medium. The storage medium may include one or a plurality of any storage mediums, for example, a ROM, a RAM, a flash memory, a hard disk, a CD-ROM, a DVD-ROM, and a flexible disk. The programs stored in the memory include, for example, a program of controlling a plating process of the substrate and a program of controlling transfer control of the substrate and the substrate holder. The controller 120 is configured to make communication with a non-illustrated upper level controller that comprehensively controls the plating apparatus and other relevant apparatuses and to exchange data with a database included in the upper level controller. The controller 120 and/or another controller or a plurality of other controllers may work in cooperation or alone to control the operations of the respective components of the plating apparatus. Each of the controller 120 and/or another controller or the plurality of other controllers may include a memory, a CPU, a sequencer, and/or an integrated circuit for specific application.

Figure 2:
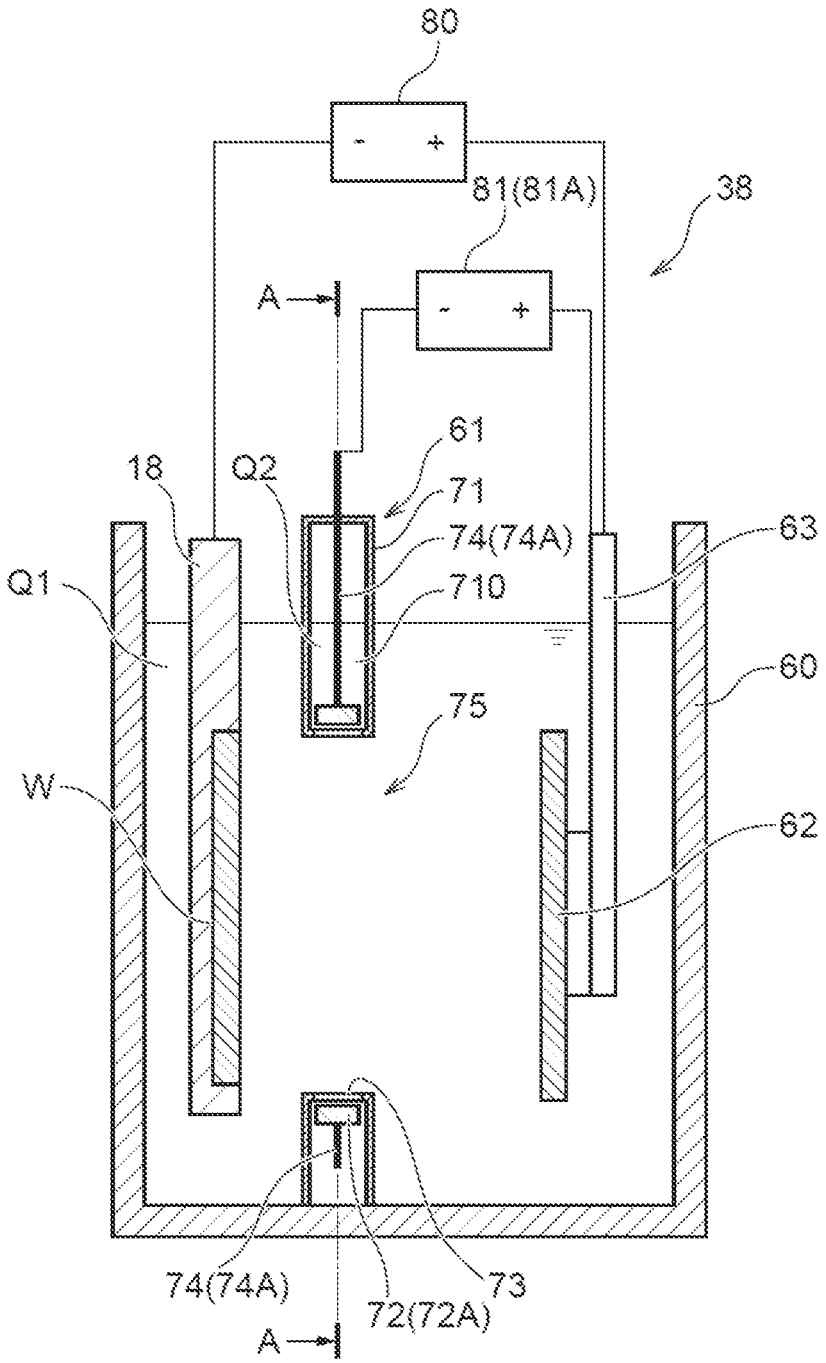
FIG. 2 is a diagram illustrating a vertical section of a plating bath.
Figure 3:
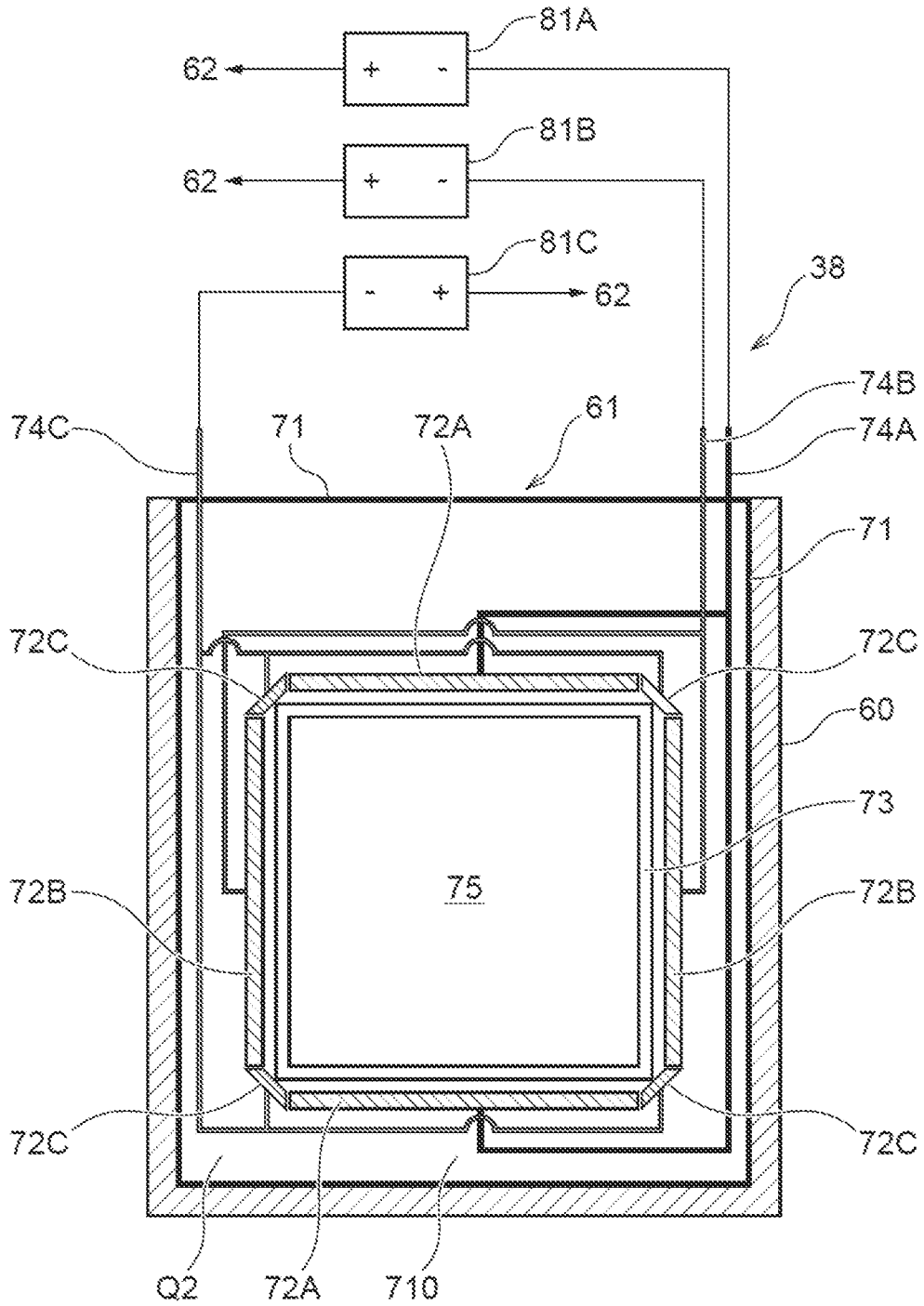
FIG. 3 is a sectional view taken in a line along a broken line A-A shown in FIG. 2.

FIG. 2 is a diagram illustrating a vertical section of the plating module. FIG. 3 is a sectional view taken in a line along a broken line A-A shown in FIG. 2. In these drawings, for convenience of explanation, a portion including one plating bath 38 of the plating module 34 is representatively illustrated with omission of the overflow tank 36. A reference sign 60 indicates a tank wall 60 of the plating module 34. The substrate holder 18 that holds the substrate W is transferred into the plating bath 38 to be soaked in a plating solution Q1. A resist pattern including openings provided at positions to form the plating film is formed on a surface to be plated (plating surface) of the substrate W. In the plating module 34, a paddle (not shown), a regulation plate 61 and an anode 62 are placed in this sequence to be opposed to the plating surface of the substrate W in the substrate holder 18. The paddle is located near to the substrate W held in the substrate holder 18 and is moved back and forth in parallel to the surface of the substrate W by the paddle driving device 46, so as to stir the plating solution Q1. The anode 62 is held by an anode holder 63 and is electrically connected with a positive electrode of a power source 80. A negative electrode of the power source 80 is electrically connected with a seed layer of the substrate W via a wiring laid in the substrate holder 18. The regulation plate 61 is one example of an electric field regulating plate and is placed between the substrate holder 18 and the anode 62 to regulate the flow of the electric field (flow of line of the electric force) between the substrate W and the anode 62. According to this embodiment, the substrate W is a rectangular substrate as one example of the angular (polygonal) substrate.

The regulation plate 61 is configured as a thief tunnel provided with auxiliary electrodes and includes a body 71 having an opening 75 and auxiliary electrodes (thief electrodes) 72 (72A to 72C) placed in the body 71. According to this embodiment, the opening 75 has dimensions substantially equal to the external dimensions of the substrate W (or the dimensions of an exposed portion of the substrate that is exposed from the substrate holder into the plating solution). According to another embodiment, the opening 75 may have dimensions smaller than the external dimensions of the substrate W (or the dimensions of an exposed portion of the substrate that is exposed from the substrate holder into the plating solution) or may have dimensions larger than the external dimensions of the substrate W (or the dimensions of an exposed portion of the substrate that is exposed from the substrate holder into the plating solution). The auxiliary electrodes 72 (72A to 72C) are provided to surround the opening 75. The body 71 is formed from a material (for example, a dielectric substance) and/or structure that is capable of shielding an electric field. According to this embodiment, the body 71 has a hollow structure including an internal space 710. The auxiliary electrodes 72 are placed in the internal space 710 of the body 71 and are electrically connected with a negative electrode of a power source 81 for auxiliary electrodes via a wiring 74 placed in the body 71 and via another wiring. A positive electrode of the power source 81 for auxiliary electrodes is electrically connected with the anode 62 via a wiring placed in the anode holder 63. Accordingly, a lower potential, i.e., a potential on the same side as the substrate W, relative to the potential of the anode 62 as a reference is applied to the auxiliary electrodes 72, so that the auxiliary electrodes 72 serve as an auxiliary cathode. Applying the potential on the same side as the substrate W to the auxiliary electrodes 72 causes part of the electric current flowing from the anode 62 toward the substrate W to flow in the auxiliary electrodes 72 and thereby controls the flow of electric current passing through the opening 75.

According to this embodiment, the auxiliary electrode 72 is divided into a plurality of auxiliary electrodes (more specifically, two auxiliary electrodes 72A, two auxiliary electrodes 72B and four auxiliary electrodes 72C). In other words, the auxiliary electrode 72 includes a plurality of auxiliary electrodes. According to another embodiment, the auxiliary electrode 72 may not be divided but have a continuous configuration or may have a configuration divided differently from the configuration shown in FIG. 3. The auxiliary electrodes 72A are placed along an upper side and a lower side of the opening 75 (corresponding to an upper side and a lower side of the substrate W). The auxiliary electrodes 72B are placed along a left side and a right side of the opening 75 (corresponding to a left side and a right side of the substrate W). The upper, lower, left and right sides herein correspond to the directions illustrated in FIG. 3. The auxiliary electrodes 72C are respectively placed at respective corners of the opening 75 (corresponding to respective corners of the substrate W; in the vicinity of intersections between respective sides of the opening or the substrate). In other words, the auxiliary electrodes 72C are arranged relative to the respective corners of the substrate W so as to overlap the respective corners of the substrate W. In the description below, there may be a simpler expression that the auxiliary electrodes 72C are arranged relative to the respective corners of the substrate W. In the illustrated example of FIG. 3, the auxiliary electrodes 72C are arranged to be opposed to apexes of the corners of the opening 75 and to be inclined to two adjoining sides of the opening 75. For example, the auxiliary electrodes 72C may be arranged at an inclination of 45 degrees relative to each of two adjoining sides of the opening 75. The inclination of the auxiliary electrodes 72C may be determined by experiments and the like as an inclination that improves the uniformity of the actual plating film.

Each of the auxiliary electrodes 72A is electrically connected with a negative electrode of a power source 81A for auxiliary electrodes via wiring 74A placed in the body 71 and via another wiring. Each of the auxiliary electrodes 72B is electrically connected with a negative electrode of a power source 81B for auxiliary electrodes via wiring 74B placed in the body 71 and via another wiring. Each of the auxiliary electrodes 72C is electrically connected with a negative electrode of a power source 81C for auxiliary electrodes via wiring 74C placed in the body 71 and via another wiring. Positive electrodes of the respective power sources 81A to 81C are electrically connected with the anode 62 via wiring placed in the anode holder 63. This configuration causes a potential on the substrate W-side relative to the potential of the anode 62 as the reference to be applied to the respective auxiliary electrodes 72A to 72C. Voltages to be applied to the auxiliary electrodes 72A, the auxiliary electrodes 72B and the auxiliary electrodes 72C may be independently controlled by the power source 81A, the power source 81B and the power source 81C, respectively. In other words, the voltages to be applied to one auxiliary electrode or multiple auxiliary electrodes and the voltages to be applied to another auxiliary electrode or other multiple auxiliary electrodes may be controlled independently. In one example, the respective auxiliary electrodes (more specifically, the respective auxiliary electrodes 72A, the respective auxiliary electrodes 72B and the respective auxiliary electrodes 72C) may be respectively connected with different power sources by different wirings, so that voltages to be applied to the respective individual auxiliary electrodes may be controlled independently. The auxiliary electrodes may be configured in a different combination other than the combination of the exemplified configuration shown in FIG. 3.

Figure 4:
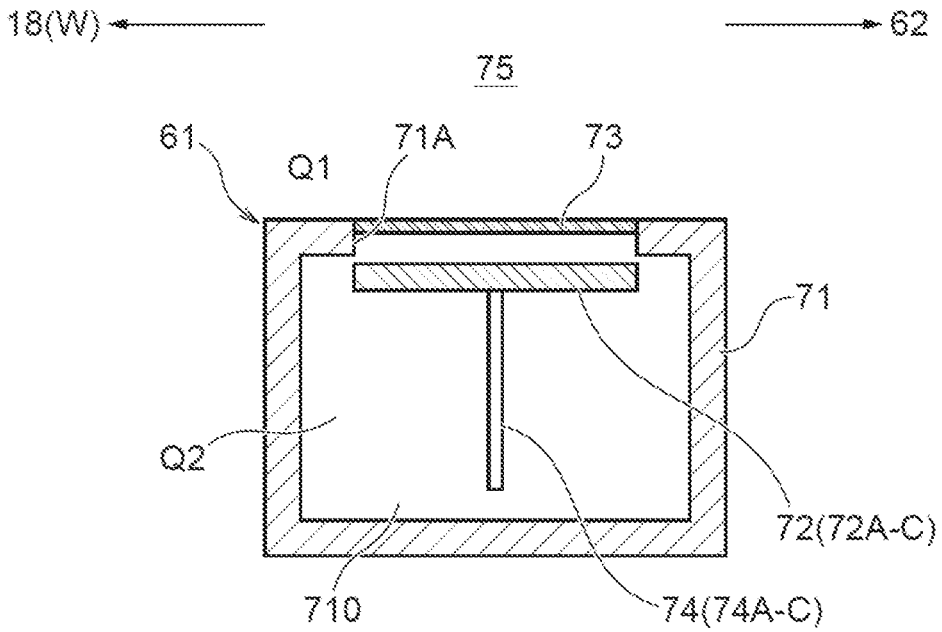
FIG. 4 is an enlarged view illustrating a configuration to place auxiliary electrodes therein.

FIG. 4 is an enlarged view illustrating a configuration in the regulation plate 61 to place the auxiliary electrodes therein. As shown in this drawing, the internal space 710 of the body 71 is filled with an electrolytic solution Q2, and the auxiliary electrodes 72 are exposed to the electrolytic solution Q2. The body 71 has an opening or passage 71A in a slit-like shape or any arbitrary shape provided in a wall of the body 71 that faces the opening 75. An ion exchange membrane 73 is mounted to close this passage 71A. The passage 71A and the ion exchange membrane 73 may be provided continuously or discretely along the whole circumference of the opening 75 or may be provided along only part of the circumference of the opening 75. The passage 71A and the ion exchange membrane 73 may be provided on a wall of the body 71 that faces the anode 62, and/or a wall of the body 71 that faces the substrate holder 18, and/or a wall (peripheral wall) of the body 71 opposite to the opening 75, in place of or in addition to the wall of the body 71 that faces the opening 75.

The ion exchange membrane 73 may be one or a plurality of membranes selected among a cation exchange membrane, a bipolar membrane, a monovalent cation-selectively permeable cation exchange membrane, and an anion exchange membrane.

In this configuration, the auxiliary electrodes 72 are exposed to the electrolytic solution Q2, and the electrolytic solution Q2 is isolated from the plating solution Q1 by the ion exchange membrane 73. This configuration suppresses a metal ion in the plating solution (for example, copper ion in copper sulfate) from entering the internal space 710 of the body 71 and thereby suppresses the metal from depositing on the auxiliary electrodes 72. Accordingly, the configuration of isolating the auxiliary electrodes 72 from the plating solution Q1 by the ion exchange membrane 73 protects the auxiliary electrodes 72. This configuration reduces the frequency of maintenance of the auxiliary electrodes 72 (for example, removal of the plating film depositing on the auxiliary electrodes and replacement of the auxiliary electrodes).

Figure 5:
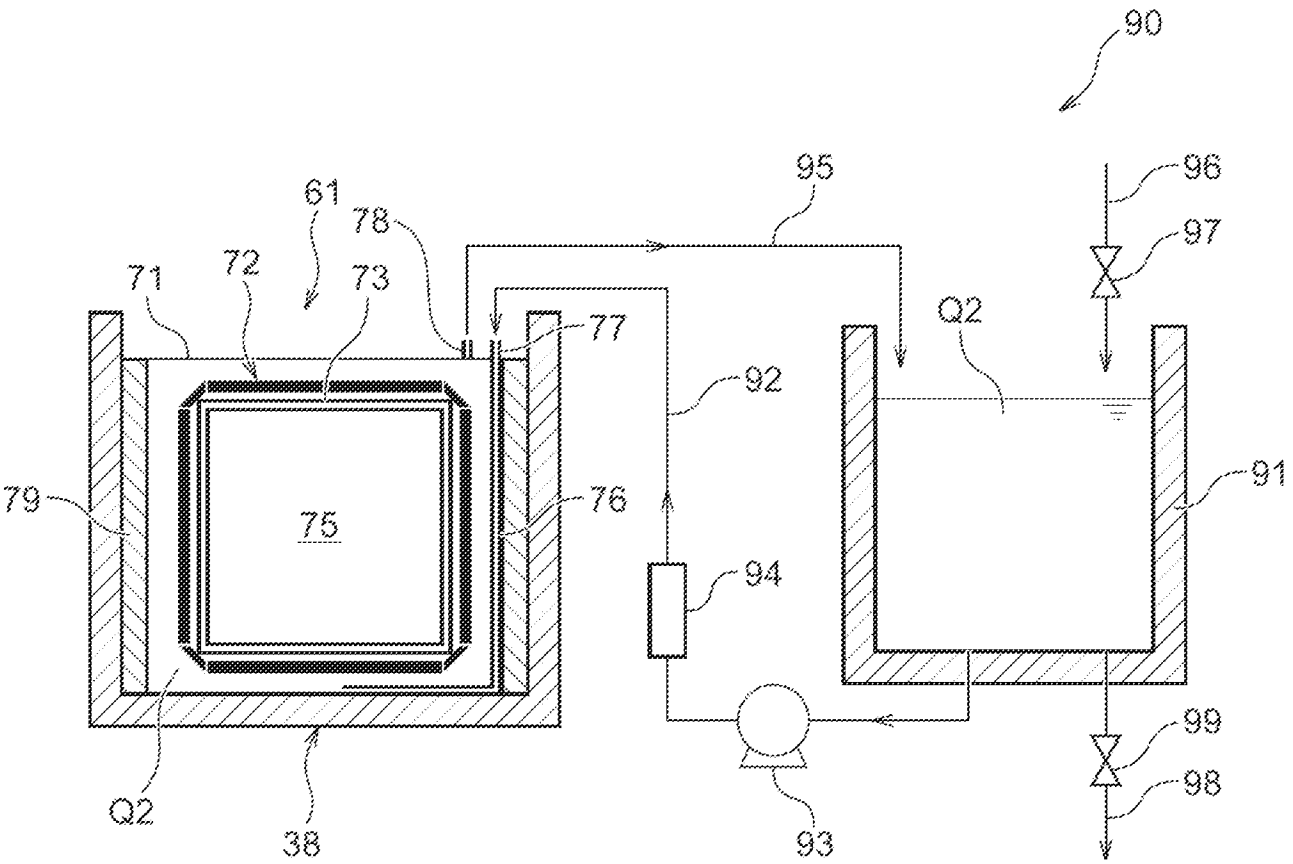
FIG. 5 is a diagram illustrating an exemplified configuration of a replacement device to replace an electrolytic solution.

FIG. 5 is a diagram illustrating an exemplified configuration of a replacement device to replace the electrolytic solution. This diagram also illustrates a regulation plate guide 79 (omitted in FIG. 2 and other drawings) configured to guide and support the regulation plate 61 in the plating bath 38. This replacement device (for example, a liquid supplier) includes a reservoir 91, a supply flow path 92 configured to supply the electrolytic solution Q2 from the reservoir 91 to the internal space 710 of the regulation plate 61, and a discharge flow path 95 configured to discharge the electrolytic solution Q2 from the internal space 710 of the regulation plate 61. The supply flow path 92 is provided with a pump 93 configured to feed the electrolytic solution Q2 in the reservoir 91 to the regulation plate 61 and a concentration meter 94 configured to measure the concentration of the metal ion in the supplied electrolytic solution Q2. The reservoir 91 receives the supply of the electrolytic solution Q2 from a supply flow path 96 that is connected with a non-illustrated supply source of the electrolytic solution Q2. The supply flow path 96 is provided with a valve 97 that opens and closes the supply flow path 96. The reservoir 91 is connected with a discharge flow path 98, and the electrolytic solution Q2 is discharged through the discharge flow path 98. The discharge flow path 98 is provided with a valve 99 that opens and closes the discharge flow path 98. The reservoir 91 serves to receive the supply of the electrolytic solution Q2 through the supply flow path 96 and accumulate the electrolytic solution Q2 therein. The reservoir 91 also serves to appropriately discharge the electrolytic solution Q2 through the discharge flow path 98. The controller 120 controls opening and closing of the valves 97 and 99, based on the concentration value of the metal ion in the electrolytic solution Q2 measured by the concentration meter 94, so as to control the concentration of the metal ion in the electrolytic solution Q2 present in the reservoir 91 and the supply flow path 92. In place of or in addition to the concentration meter 94, another concentration meter may be placed in the internal space 710 to measure the concentration of the metal ion in the electrolytic solution Q2 present in the internal space 710.

A port 77 connected with the supply flow path 92 from the reservoir 91 and a port 78 connected with the discharge flow path 95 to the reservoir 91 are provided above the body 71 of the regulation plate 61. The ports 77 and 78 are openings or passages provided to connect the inside (internal space 710) of the body 71 with the outside and include, for example, connectors for connecting with the supply flow path 92 and/or the discharge flow path 95. A supply pipe 76 placed in the internal space 710 of the body 71 is connected with the port 78. The supply pipe 76 is configured to be extended downward from an upper portion toward a bottom portion of the internal space 710 of the body 71 and to be opened in the bottom portion. In this configuration, the electrolytic solution Q2 is supplied from the bottom portion in the internal space 710 of the body 71, and the internal space 710 is filled with the electrolytic solution Q2 upward from the lower portion to the upper portion. The electrolytic solution Q2 overflowing from the internal space 710 is discharged through the discharge flow path 95 to the reservoir 91. This configuration causes the internal space 710 of the body 71 to be filled with the electrolytic solution Q2.

The replacement device of the above configuration serves to supply the electrolytic solution Q2 from the reservoir 91 into the body 71 of the regulation plate 61, to fill the inside of the body 71 with the electrolytic solution Q2, to make the auxiliary electrodes 72 exposed to the electrolytic solution Q2, and to return the electrolytic solution Q2 overflowing from the inside of the body 71 through the discharge flow path 95 to the reservoir 91. This configuration suppresses an increase in the concentration of the metal ion in the electrolytic solution Q2 which the auxiliary electrodes 72 are exposed to, so as to keep the concentration of the metal ion at low level, while enabling hydrogen gas generated by an electrode reaction at the auxiliary electrodes 72 to be discharged out of the regulation plate 61. The configuration of discharging the electrolytic solution Q2 from the reservoir 91 and supplying a new electrolytic solution Q2 to the reservoir 91 enables the electrolytic solution Q2 in the reservoir 91 to be always kept fresh (i.e., suppresses an increase in the concentration of the metal ion in the electrolytic solution Q2 present in the reservoir 91) and thereby further suppresses an increase in the concentration of the metal ion in the electrolytic solution Q2 which the auxiliary electrodes 72 are exposed to.

Figure 6:
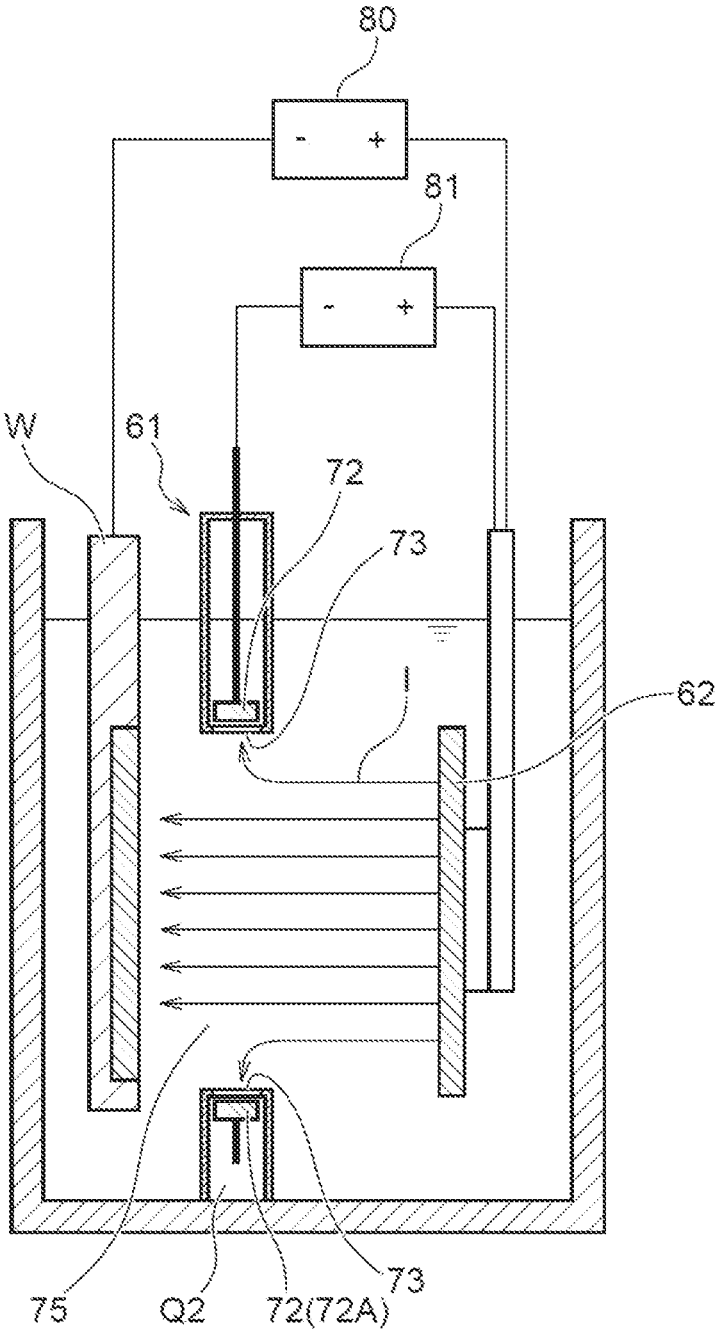
FIG. 6 is a diagram illustrating control of electric current in the process of plating by a thief tunnel.

FIG. 6 is a diagram illustrating control of electric current in the process of plating by the thief tunnel. According to the embodiment described above, as illustrated in this drawing, the plating current (film-forming current) made to flow in the substrate W can be controlled by controlling the electric field (electric current) flowing from the anode 62 to the substrate W-side by the opening 75 of the regulation plate 61 and in addition by making part of the electric field (electric current) flow in the auxiliary electrodes 72. This configuration can control the electric field to the further inside of the opening 75 of the regulation plate 61 and thereby control the electric current. The auxiliary electrodes 72C (shown in FIG. 3) are located at the positions corresponding to the corners of the substrate. This configuration reduces (or increases) the plating current flowing in the corners of the substrate and reduces (or increases) the film thickness of the plating film at the corners. When there is a difference in the plating film thickness among areas in the respective sides of the substrate (for example, a center area, an intermediate area(s) between the center area and the corners), the auxiliary electrodes 72A and/or the auxiliary electrodes 72B located along the respective sides may be divided corresponding to the respective areas, so that the voltage may be controlled with regard to each of the auxiliary electrodes in the respective areas.

According to an aspect of the present disclosure, a plurality of thief tunnels may be placed between the anode holder 63 and the substrate holder 18. The short distance between the thief tunnel and the substrate holder 18 enables a distribution of the plating film thickness to be controlled in a substrate edge portion, whereas the long distance between the thief tunnel and the substrate holder enables the distribution of the film thickness to be controlled in the whole substrate. Accordingly, for example, a configuration of locating a first thief tunnel near to the substrate holder 18 and a second thief tunnel near to the anode holder 63 and independently controlling the electric currents in the respective thief tunnels enables the distribution of the plating film thickness to be controlled more strictly.

The voltages or the electric currents applied to the auxiliary electrodes 72 may be changed with a variation in plating time or may be kept constant. In the process of electroplating, the small film thickness and the high electric resistance of the seed layer tend to provide a high plating deposition rate in a substrate end portion near to the cathode electrode (power feed electrode) and a low plating deposition rate in a substrate center portion. In the case where a resist pattern formed on a substrate to be plated has a sufficiently high opening ratio, the resistance of a conductive layer on the substrate decreases accompanied with plating deposition. Accordingly, the plating deposition rate decreases in the substrate end portion and increases in the substrate center portion with elapse of the plating time. In the case where the resist pattern has a sufficiently high opening ratio, the deposition rate of the plating film can thus be equalized by controlling the voltage that is to be applied to the auxiliary electrodes 72, such as to be high at a start of plating when the plating deposition rate is high in the substrate end portion and to be decreased with elapse of the plating time. This configuration ensures the good in-plane uniformity of the plating film thickness, irrespective of a variation in target plating film thickness.

Figure 7:
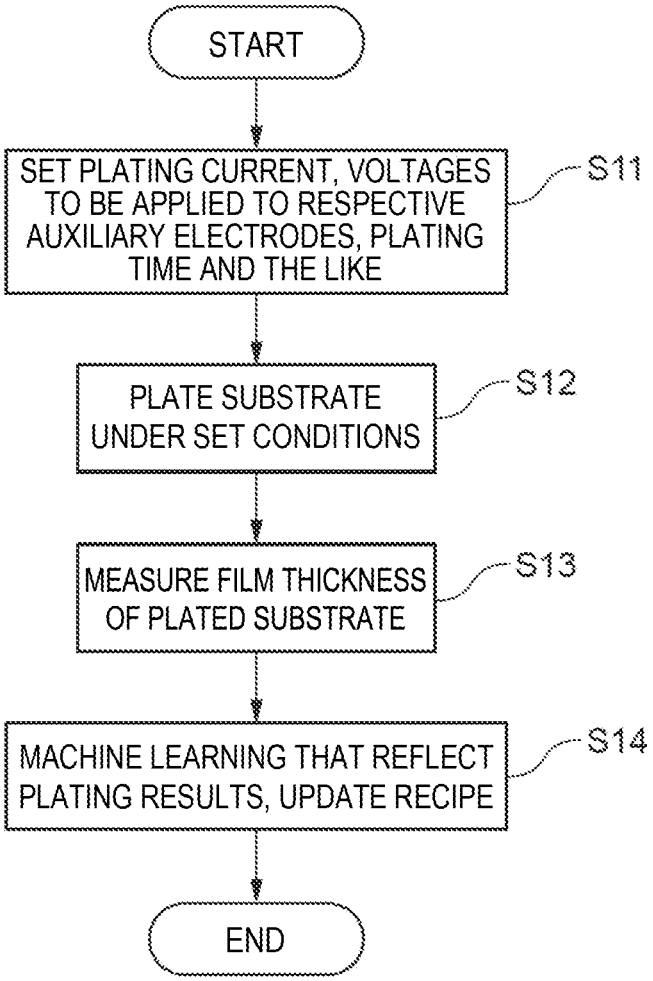
FIG. 7 is a flowchart showing a plating process.

FIG. 7 is a flowchart showing a plating process. This process is performed by the controller 120. The controller 120 and/or another controller or a plurality of other controllers may work in cooperation or alone to perform this process.

At S11, the controller sets a plating current made to flow in the substrate, voltages to be applied to the respective auxiliary electrodes 72A to 72C (or electric currents made to flow in the respective auxiliary electrodes 72A to 72C), a plating time and the like. The plating current, the electric currents or the voltages of the auxiliary electrodes, the plating time and the like are determined in advance according to the process by experiments or the like.

The plating current, the electric currents or the voltages of the auxiliary electrodes, the plating time and the like may be determined by machine learning. The following describes an exemplified procedure. The procedure may repeat an experiment of plating an object to be plated (plating object, substrate) in one or a plurality of initial conditions with changing process conditions and/or changing a plating solution to be used, and measure the thickness of a plating film of the plated substrate by a film thickness meter (film thickness measuring instrument) or the like to collect data of plating results. The initial conditions of the object to be plated include, for example, a device structure pattern and a seed layer (material, generation process, thickness and the like) of the object to be plated. The process conditions include variations since a process start time in voltages and/or electric current values (control values) of respective power feed points on the substrate and respective auxiliary electrodes, and a plating time. Data for specifying the plating solution include, for example, a plating material and its content, a solution resistance, and concentrations of additives (inhibitors, accelerators, levelers and the like). The plating results are, for example, irregular shape measurement values at a plurality of points in a plating plane.

In parallel with the collection of the experiment results described above, the controller uses data of the plating results, the process conditions, the initial conditions of the object to be plated, and the data of the plating solution as teacher data, learns process conditions for providing even plating film thicknesses in respective portions of the plating plane by machine learning such as AI, and causes the process conditions to be updated and reflected on a subsequent recipe, as needed basis. The process conditions (recipe) for providing the even plating film thickness are determined by such machine learning.

Referring back to the flowchart of FIG. 7, at S12, the controller causes the substrate W to be plated under the conditions of the plating current, the electric currents or the voltages of the auxiliary electrodes, the plating time and the like set at S11.

At S13, the controller measures the plating film of the plated substrate W by a film thickness meter or the like to collect data of the plating results (for example, irregular shape measurement values at a plurality of points in a plating plane). This measurement may be performed after removal of the resist from the substrate, or may be performed before removal of the resist when a measuring instrument that is capable of measuring the plating film thickness irrespective of the presence or the absence of a resist is used.

At S14, the controller causes the process conditions, the initial conditions, the plating solution, and the plating results with regard to a current plating to be learned by machine learning such as AI in a similar manner to the process for determining the recipe described above and determines process conditions (process conditions for proving the even plating film thickness) by taking into account the current plating results. This configuration continuously optimizes the process conditions (improve the in-plane uniformity and shorten the plating time) and thereby continuously improves the plating quality.

A modified configuration may cause the processing of S14 to be performed by an edge computer attached to the plating apparatus, collect respective data in a Fog system in a FAB and send required data to a cloud. Constructing a system via these networks enables data to be instantaneously shared and complemented not only by a conventional single plating apparatus but between a plurality of plating apparatuses in a FAB. This configuration also allows for data sharing between FABs via a cloud and also allows for expansion of a recipe suitable for a plurality of plating apparatuses installed in a plurality of FABs. The machine learning may be performed by the Fog system in the FAB or by another computer or a plurality of other computers on a cloud. The machine learning may also be performed by one or multiple in combination among the edge computer, the Fog system in the FAB, and another or the plurality of other computers on the cloud.

When the plating current to be supplied to the power feed electrode on the substrate is related to the voltages or the electric currents to be supplied to the auxiliary electrodes by a function or the like, the voltages or the electric currents to be supplied to the auxiliary electrodes may be expressed by the plating current. This is likely to reduce the number of parameters in machine learning and reduce the time and/or the cost required for machine learning.

OTHER EMBODIMENTS (1) According to the embodiment described above, the auxiliary electrode is divided into the eight electrodes arranged along the upper side, the lower side, the left side, the right side and at the respective corners. The auxiliary electrode may, however, be divided into any number and in any arrangement for its purpose.

(2) According to the configuration of the embodiment described above, the auxiliary electrodes are placed in the body of the regulation plate (the internal space 710). According to another embodiment, a housing may be provided on an outer surface of the body of the regulation plate, and the auxiliary electrodes may be placed in the housing. One of the faces separating the housing may be a wall or an outer surface of the body of the regulation plate. The inside of the housing may be filled with an electrolytic solution like the embodiment described above, and an opening or a passage provided in the housing may be closed by an ion exchange membrane. According to another embodiment, the auxiliary electrodes may be provided on a structure other than the regulation plate.

(3) According to the configuration of the embodiment described above, the divided auxiliary electrodes are placed in the common space provided in the body. According to another embodiment, part of or each of the auxiliary electrodes may be placed in a space that is separated from the other auxiliary electrodes by a partition wall or the like, and each separate or isolated space may be filled with an electrolytic solution. In this embodiment, the electrolytic solution in each separate or isolated space may be replaced with a view to suppressing an increase in the concentration of the metal ion.

(4) According to another embodiment, the power source 81 may have the positive electrode connected with the auxiliary electrodes and the negative electrode connected with the substrate, and the auxiliary electrodes may be used as an auxiliary anode. In one example, when a partial area on the substrate (for example, corner) has the smaller film thickness than the other area, the auxiliary electrodes at positions corresponding to this partial area on the substrate may be used as an auxiliary anode to increase the plating film thickness in this partial area.

(5) The configuration of the embodiment described above is applicable to any angular (polygonal) substrate other than the rectangular shape, a circular substrate or a substrate in any other arbitrary shape.

(6) The configuration of the auxiliary electrodes and the control of the voltages according to the embodiment described above may be used in combination with the control of the power feed current according to the area on the substrate (as described in, for example, Japanese Unexamined Patent Publication No. 2017-043815 (Patent Document 3)). This configuration enables the plating current to be controlled with the higher accuracy according to the respective areas on the substrate and thus further improves the uniformity of the plating film thickness. The entire disclosure including the specification, the claims and the abstract of Japanese Unexamined Patent Publication No. 2017-043815 (Patent Document 3) is incorporated herein by reference in its entirety.

(7) According to another embodiment, the regulation plate (thief tunnel) 61 may be formed in a ring shape, and a gap may be provided between the regulation plate 61 and the tank wall 61 of the plating bath 38. This configuration causes the electric field (electric current) to flow from the anode 62 toward the substrate W additionally on the outside of the regulation plate 61. In this embodiment, for example, the respective auxiliary electrodes 72 may be arranged such that part of the auxiliary electrodes 72 control the flow of the electric field inside of the regulation plate 61 and that part of the auxiliary electrodes 72 control the flow of the electric field outside of the regulation plate 61. In another example, the respective auxiliary electrodes 72 may be arranged such that all the auxiliary electrodes 72 control the flow of the electric field both inside and outside of the regulation plate 61. The configurations can not only control the flow of the electric field at the opening inside of the regulation plate also control the flow of the electric field outside of the thief tunnel. This further enhances the flexibility in regulation of the flow of the electric field (electric current) to the respective portions of the substrate. In another example, the respective auxiliary electrodes 72 may be arranged such that all the auxiliary electrodes 72 control the flow of the electric field inside of the regulation plate 61.

At least the following aspects are provided from the embodiments described above.

According to a first aspect, there is provided an apparatus for plating a substrate as an object to be plated. The apparatus for plating comprises an anode configured to make electric current flow between the substrate and the anode; and a thief tunnel arranged to be located between the substrate and the anode when the substrate is placed to be opposed to the anode. The thief tunnel comprises a body placed away from the substrate and provided with an opening; a plurality of auxiliary electrodes provided in or to the body; and an ion exchange membrane configured to protect the auxiliary electrodes from a plating solution. The plurality of auxiliary electrodes are arranged along a circumference of the opening. At least one of the auxiliary electrodes is configured such that a voltage to be applied to the at least one of the auxiliary electrodes is controlled independently of a voltage to be applied to one or more auxiliary electrodes other than the at least one of the auxiliary electrodes. The thief tunnel serves as an electric field regulating mask. The thief tunnel serves to control (limit or increase) from the anode to part or the entirety of a substrate surface. An opening of the thief tunnel may have dimensions that are equal to or smaller than the external dimensions of the substrate (or the dimensions of an exposed portion of the substrate that is exposed to a plating solution). In other words, when the substrate is laid over the thief tunnel, the external dimensions of the substrate (or the dimensions of the exposed portion of the substrate) may be such dimensions that include the opening of the thief tunnel. The dimensional relationship may, however, be opposite to the foregoing relationship. The external dimensions of the substrate (or the dimensions of the exposed portion of the substrate) may be identical with the dimensions of the opening of the thief tunnel.

When there is a demand for controlling the electric current flowing in the substrate to the further deep inside from the opening of the electric field regulating mask, the apparatus for plating of this aspect causes the electric field regulating mask to be configured as the thief tunnel and causes part of electric current to flow between the auxiliary electrodes and the anode, so as to change the electric current that flows from the anode and reaches the substrate surface. This configuration improves the regulation accuracy in a distribution of plating film thickness. Furthermore, the apparatus for plating of this aspect enables a voltage to be supplied to an auxiliary electrode(s) corresponding to a specific location(s) or portion(s) of the substrate independently of the other auxiliary electrode(s). This configuration controls (limits or increases) the electric current according to the location on the substrate and thereby more readily controls the uniformity of the film thickness according to the specification of the substrate. This accordingly improves the uniformity of the plating film thickness with regard to a wide variety of substrates. Different products may have different resist patterns on a substrate, different opening ratios of the resist pattern, different film thicknesses of a seed layer and the like. Even in such cases, the configuration of this aspect further readily controls the plating current and the plating film thickness for each product by controlling the voltage or the electric current to be applied to each of the auxiliary electrodes. For example, in the case where electric current is concentrated in a specific location(s) in a periphery of a substrate (for example, a corner of a polygonal substrate) to provide a large plating film thickness, the distribution of the film thickness may be improved by activating only an auxiliary electrode at a corresponding position (auxiliary electrode at a position(s) corresponding to the specific location(s) or at a position(s) corresponding to the vicinity of the specific location(s)) or by activating the auxiliary electrode at the corresponding position with a lower potential than the other auxiliary electrodes. In another example, in the case where small electric current flows in a specific location(s) in a periphery of a substrate (for example, a corner of a polygonal substrate) to provide a small plating film thickness, the distribution of the film thickness may be improved by inactivating only an auxiliary electrode at a corresponding position (auxiliary electrode at a position(s) corresponding to the specific location(s) or at a position(s) corresponding to the vicinity of the specific location(s)) or by activating the auxiliary electrode at the corresponding position with a higher potential than the other auxiliary electrodes. Accordingly, one or a plurality of auxiliary electrodes may be configured as an auxiliary cathode or as an auxiliary anode, so that part of the auxiliary electrodes may be configured as an auxiliary cathode and the other auxiliary electrodes may be configured as an auxiliary anode.

In the apparatus for plating of this aspect, the auxiliary electrodes are arranged along the circumference of the opening of the thief tunnel body. This configuration enables the electric field flowing relative to any location on the substrate to be readily controlled by the auxiliary electrodes and enhances the effect of controlling (limiting or increasing) the electric current flowing in the substrate. This configuration also enables a distribution of electric field (a distribution of electric current) to be controlled without changing the dimensions of the opening of the electric field regulating mask. Moreover, this configuration allows for omission of a configuration, such as a driving device to change the dimensions of the opening of the electric field regulating mask and thereby prevents complication of the mechanical configuration.

The auxiliary electrodes are protected (isolated) from a plating solution by an ion exchange membrane (for example, a cation exchange membrane, a bipolar membrane, a monovalent cation-selectively permeable cation exchange membrane, and an anion exchange membrane). This configuration suppresses plating deposition or resolution on the auxiliary electrodes. This configuration accordingly reduces the frequency of maintenance of the auxiliary electrodes (for example, removal of the plating film depositing on the auxiliary electrodes and replacement of the auxiliary electrodes).

The auxiliary electrodes are placed away from the substrate holder or the anode. This configuration readily provides a space for a configuration that fixes the auxiliary electrodes or a configuration that protects the auxiliary electrodes and enhances the flexibility of a configuration to install the auxiliary electrodes. The thief tunnel may be configured by providing auxiliary electrodes on an electric field regulating plate such as a regulation plate. This configuration may be achieved without significantly changing the dimensions of the existing electric field regulating plate.

According to a second aspect, in the apparatus for plating of the first aspect, the auxiliary electrodes may be placed in a housing that is provided in or to the body and may be exposed to an electrolytic solution in the body or in the housing. The ion exchange membrane may be placed in a passage arranged to connect a space inside of the body or inside of the housing with outside. The housing may be a chamber provided in the body (a structure surrounding an internal space) or a chamber attached to the body (a structure surrounded by a walks) different from the body).

In the apparatus for plating of this aspect, the auxiliary electrodes are surrounded by or exposed to the electrolytic solution, and the electrolytic solution is isolated from a plating solution by the ion exchange membrane. This configuration suppresses a metal ion in the plating solution from coming into contact with the auxiliary electrodes and thereby suppresses plating deposition onto the auxiliary electrodes.

According to a third aspect, the apparatus for plating of the second aspect may further comprise a structure provided in the body or in the housing and configured to replace the electrolytic solution.

The apparatus for plating of this aspect enables the electrolytic solution which the auxiliary electrodes are exposed to, to be replaced as needed basis. This configuration enables the electrolytic solution to be kept fresh and further suppresses the concentration of a metal ion included in the electrolytic solution. Moreover, this configuration suppresses hydrogen gas generated by an electrode reaction at the auxiliary electrodes from being accumulated in the body or in the housing.

According to a fourth aspect, in the apparatus for plating of the third aspect, the structure configured to replace the electrolytic solution may comprise an electrolytic solution supplier and/or an electrolytic solution discharger provided in the body or in the housing.

The electrolytic solution supplier and/or the electrolytic solution discharger may be provided separately, or a single port may be used as both the electrolytic solution supplier and the electrolytic solution discharger to supply and discharge the electrolytic solution. The apparatus for plating of this aspect enables a new electrolytic solution to be supplied and/or enables an old electrolytic solution to be discharged via the electrolytic solution supplier and/or the electrolytic solution discharger provided in the body or the like. This configuration enables the electrolytic solution which the auxiliary electrodes are exposed to, to be kept fresh and further suppresses an increase in the concentration of the metal ion included in the electrolytic solution. This configuration also enables hydrogen gas generated by the electrode reaction at the auxiliary electrodes to be discharged out of the thief tunnel as needed basis.

According to a fifth aspect, in the apparatus for plating of any one of the first aspect to the fourth aspect, the auxiliary electrodes may be arranged adjacent to the opening.

In the apparatus for plating of this aspect, the auxiliary electrodes are placed near to the opening of the thief tunnel body. This configuration enables an electric field by the auxiliary electrodes to efficiently act on the electric current flowing through the opening and enhances the effect of controlling (limiting or increasing) the electric current flowing in the substrate.

According to a sixth aspect, in the apparatus for plating of any one of the first aspect to the fifth aspect, the substrate may be a polygonal substrate, and at least one of the plurality of auxiliary electrodes may be located at a position corresponding to a corner of the substrate.

In the apparatus for plating of this aspect, in the case where electric current is concentrated in a specific location(s) (for example, a corner(s)) of a polygonal substrate to provide a large plating film thickness, the distribution of the film thickness may be improved by activating only an auxiliary electrode at a corresponding position (auxiliary electrode at a position(s) corresponding to the specific location(s) or at a position(s) corresponding to the vicinity of the specific location(s)) or by activating the auxiliary electrode at the corresponding position with a lower potential than the other auxiliary electrodes. In the case where small electric current flows in a specific location (s) in a periphery of a substrate (for example, a corner of a polygonal substrate) to provide a small plating film thickness, the distribution of the film thickness may be improved by inactivating only an auxiliary electrode at a corresponding position (auxiliary electrode at a position corresponding to the specific location(s) or at a position corresponding to the vicinity of the specific location(s)) or by activating the auxiliary electrode at the corresponding position with a higher potential than the other auxiliary electrodes. As a result, this configuration enables the plating film thickness to be favorably controlled at the corner of the polygonal substrate.

According to a seventh aspect, in the apparatus for plating of any one of the first aspect to the sixth aspect, the body may be made of a dielectric material and may be configured such as to interrupt a flow of an electric field outside of the opening.

In the apparatus for plating of this aspect, the flow of the electric field passing through a location other than the opening to be effectively interrupted by the body of the dielectric material.

According to an eighth aspect, in the apparatus for plating of any one of the first aspect to the seventh aspect, the thief tunnel may be in a ring shape, and at least one of the auxiliary electrodes may be configured to control a flow of an electric field inside and/or outside of the thief tunnel.

The apparatus for plating of this aspect enables the flow of the electric field at the opening inside of the thief tunnel to be controlled by part or all of the auxiliary electrodes and/or enables the flow of the electric field outside of the thief tunnel to be controlled by part or all of the auxiliary electrodes. This configuration further enhances the flexibility in regulation of the flow of the electric field (electric current) to the respective portions of the substrate.

Although the embodiments of the present invention have been described based on some examples, the embodiments of the invention described above are presented to facilitate understanding of the present invention, and do not limit the present invention. The present invention can be altered and improved without departing from the subject matter of the present invention, and it is needless to say that the present invention includes equivalents thereof. In addition, it is possible to arbitrarily combine or omit respective constituent elements described in the claims and the specification in a range where at least a part of the above-mentioned problem can be solved or a range where at least a part of the effect is exhibited.

The present application claims priority from the Japanese patent application No. 2019-127501 filed on Jul. 9, 2019. The entire disclosure of the Japanese patent application No. 2019-127501 filed on Jul. 9, 2019, including the specification, the claims, the drawings and the abstract is incorporated herein by reference in its entirety. The entire disclosures of Japanese Unexamined Patent Publication No. 2018-040045 (Patent Document 1), Japanese Patent Application No. 2018-079388 (Patent Document 2), Japanese Unexamined Patent Publication No. 2017-043815 (Patent Document 3) and Japanese Unexamined Patent Publication No. 2019-014955 (Patent Document 4), including the specifications, the claims, the drawings and the abstracts are incorporated herein by reference in their entireties.

REFERENCE SIGNS LIST

1 plating apparatus
12 cassette table
14 aligner
16 spin dryer
20 loading/unloading station
22 substrate transfer device
24 stocker
26 prewet module
28 presoak module
30*a* first rinse module
30*b* second rinse module
32 blow module
34 plating module
38 plating bath
36 overflow tank
18 substrate holder
61 regulation plate
62 anode
63 anode holder
71 body
71A passage
710 internal space
72 auxiliary electrode
72A auxiliary electrode
72B auxiliary electrode
72C auxiliary electrode
73 ion exchange membrane
74A wiring
74B wiring
74C wiring
75 opening
76 supply pipe
77 port
78 port
79 regulation plate guide
80 power source
81 power source
81A power source
81B power source
81C power source
91 reservoir
92 supply flow path
93 pump
94 concentration meter
95 discharge flow path
96 supply flow path
97 valve
98 discharge flow path
99 valve
120 controller
120A memory
120B CPU

What is claimed is:

1. An apparatus for plating a substrate as an object to be plated using a plating solution, the apparatus for plating comprising:

a plating tank configured to contain the plating solution;

a substrate holder;

an anode placed in the plating tank and configured to make electric current flow between the substrate and the anode; and a thief tunnel placed in the plating tank and arranged to be located between the substrate and the anode when the substrate is placed to be opposed to the anode, wherein the substrate holder and the thief tunnel are not in direct contact by being configured to have plating solution in between, wherein the thief tunnel comprises:

a regulation plate placed in the contained plating solution in the plating tank and away from the substrate and provided with a single opening configured to regulate an electric field between the anode and the substrate, the regulation plate located in the plating tank in a vertical attitude;

a regulation plate guide configured to guide and support the regulation plate in the plating tank;

at least one auxiliary electrode provided in an internal space inside the regulation plate and exposed to an electrolytic solution in the internal space; and an ion exchange membrane placed in a passage arranged to connect the internal space inside of the regulation plate with outside and configured to protect the at least one auxiliary electrode from being plated, and wherein the at least one auxiliary electrode is arranged along a circumference of the opening.

2. The apparatus for plating according to claim 1, further comprising:

an electrolytic solution supply port and an electrolytic solution discharge port separate from the electrolytic solution supply port, which are provided in the regulation plate and configured to replace the electrolytic solution.

3. The apparatus for plating according to claim 1, wherein the at least one auxiliary electrode is arranged adjacent to the opening.

4. The apparatus for plating according to claim 1, wherein the substrate is a polygonal substrate, and one or more of the at least one auxiliary electrode is located at a position corresponding to a corner of the substrate.

5. The apparatus for plating according to claim 1, wherein the regulation plate is made of a dielectric material and is configured to interrupt a flow of an electric field outside of the opening.

6. The apparatus for plating according to claim 1, wherein the thief tunnel is in a ring shape, and at least one of the at least one auxiliary electrode is configured to control a flow of an electric field inside and/or outside of the thief tunnel.

7. An apparatus for plating a substrate as an object to be plated using a plating solution, the apparatus for plating comprising:

a plating tank configured to contain the plating solution;

an anode placed in the plating tank and configured to make electric current flow between the substrate and the anode;

a substrate holder; and a thief tunnel placed in the plating tank and arranged to be located between the substrate and the anode when the substrate is placed to be opposed to the anode, wherein the substrate holder and the thief tunnel are not in direct contact by being configured to have plating solution in between, wherein the thief tunnel comprises:

a regulation plate placed in the contained plating solution in the plating tank and away from the substrate and provided with a single opening configured to regulate an electric field between the anode and the substrate, the regulation plate located in the plating tank in a vertical attitude;

a regulation plate guide configured to guide and support the regulation plate in the plating tank;

at least one auxiliary electrode provided in an internal space inside the regulation plate and exposed to an electrolytic solution in the internal space; and an ion exchange membrane placed in a passage arranged to connect the internal space inside of the regulation plate with outside and configured to protect the at least one auxiliary electrode from being plated, and wherein the at least one auxiliary electrode is arranged adjacent to the opening and along a circumference of the opening, and wherein the substrate is a polygonal substrate, and one or more of the at least one auxiliary electrode is located at a position corresponding to a corner of the substrate.

* * * * *